US007188553B1

(12) United States Patent
Pryor

(10) Patent No.: US 7,188,553 B1
(45) Date of Patent: Mar. 13, 2007

(54) EXTENDABLE EXTENSION AND METHOD OF USE

(76) Inventor: Troy D. Pryor, 11152 E. Carpenter Rd., Davison, MI (US) 48423

( * ) Notice: Subject to any disclaimer, the term of this patent is extended or adjusted under 35 U.S.C. 154(b) by 82 days.

(21) Appl. No.: 11/212,217

(22) Filed: Aug. 26, 2005

(51) Int. Cl.
*B25B 23/16* (2006.01)

(52) U.S. Cl. ..... 81/177.2; 81/439

(58) Field of Classification Search ..... 403/326, 403/327, 109; 81/177.2, 439, 125.1, 185
See application file for complete search history.

(56) References Cited

U.S. PATENT DOCUMENTS 798,325 A 8/1905 Daddysman, Jr.
2,735,325 A 2/1956 Rudd, Sr.
3,227,015 A 1/1966 Trembllay
6,155,144 A * 12/2000 Lin ..... 81/438
6,523,441 B2 * 2/2003 Lee ..... 81/177.85
6,761,094 B2 * 7/2004 Tobako ..... 81/177.2

* cited by examiner

*Primary Examiner*—Jacob K. Ackun, Jr.
(74) *Attorney, Agent, or Firm*—Raymond M. Galasso; Galasso & Associates, L.P.

(57) ABSTRACT

The extendable socket extension is a tool that allows the user to be able to reach into small, tight places to either attach or remove bolts or screws. A first piece and a second piece are slideably connected. By using a thumb release, the second piece can slide in or out to a desired length. Once the desired length is reached the thumb release engages a locking pin holding the first and second piece to the desired length. A ratchet is then attached to the first piece and a socket wrench is attached to the second piece. The socket wrench is then attached to the bolt or screw to be inserted and removed and is rotated into or out of the desired location by the ratchet.

16 Claims, 2 Drawing Sheets

EXTENDABLE EXTENSION AND METHOD OF USE

FIELD OF THE DISCLOSURE

An extendable tool that attaches to a ratchet allowing the user to be able to reach screws and bolts that might otherwise be unreachable.

BACKGROUND

Trying to remove a screw or bolt in a tight place has long been a problem that most have faced in their lives. Whether you need a shorter tool or a longer tool, either can be problematic. Since most extensions come in designated lengths being able to find the right length is not always easy to do.

Automobile and truck mechanics face this problem on a daily basis. They are constantly trying to find the proper tool to fit into a particular place when they are working on cars especially. They are constantly cutting their fingers or hands trying to get into a small area or to get a wrench turned in the proper direction and inserted on to a particular bolt or screw. As the engines of cars get smaller and more compact, this task becomes more and more difficult. Also, finding a tool that is the proper length to be able to insert in some of these places to remove or insert bolts or screws is very difficult. While there are standard extensions that are available for purchase they do not fit every situation. Therefore, on some occasions, a mechanic may end up having to piece two or more extensions together to get it to the proper length. Other times, the task is more difficult because all of the extensions are too long and yet the wrench or socket itself is too short. The alternative is to remove more parts than would normally be required to actually do the repair or replacement. This in turn causes the cost of the repair or replacement to increase. In addition to the increased cost, there is an increased amount of time required to actually perform the repair or replacement.

There are other situations when someone might need to be able to adjust the length of a particular socket type wrench. Even some home repairs such as plumbing could sometimes require repairing or replacing parts in some very tight places. Unfortunately, the ability to tear out lots of other pieces to get to a potential plumbing problem creates a much bigger problem and is not always feasible to do. For example, you would not want to tear out the entire sink and/or cabinet in the kitchen or bath if you need to replace certain plumbing parts. Other tight spots that might require that you need an adjustable socket type wrench could include working on a hot water heater. Usually hot water heaters are placed in small closets and do not contain a lot of access to work on them. Even being able to get the hot water heater out to do work on it can become a major project.

All of these types of situations need a solution that is feasible and makes the process much easier while reducing the time and cost associated with any repairs or replacements.

SUMMARY OF THE DISCLOSURE

In one embodiment of the present invention the extendable socket extension a first piece and a second piece.

In another embodiment the extendable socket extension comprises a ball bearing connection operable to attach a socket.

In another embodiment the extendable socket extension comprises a rocker release mechanism.

In yet another embodiment the extendable socket extension comprises raised collar.

In still another embodiment the extendable socket extension the rocker release switch mechanism is located on the raised collar.

In another embodiment the rocker release switch mechanism allows a second piece to extend and retract.

In yet another embodiment the rocker release switch mechanism operates to engage and release a locking pin.

In still another embodiment the first piece comprises an internal square bore.

In another embodiment the extendable socket extension second piece comprises a square shaft.

In another embodiment the second piece comprises a groove containing a set of holes operable to insert a locking pin.

In yet another embodiment the holes are located at a specified interval.

In still another embodiment the extendable socket extension comprises a thumb button.

DETAILED DESCRIPTION OF THE DRAWING FIGURES

In the following detailed description of the preferred embodiments, reference is made to the accompanying drawings which form a part hereof, and in which is shown by way of illustration specific preferred embodiments in which the invention may be practiced. These embodiments are described in sufficient detail to enable those skilled in the art to practice the invention, and it is to be understood that other embodiments may be utilized and that logical, mechanical and electrical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
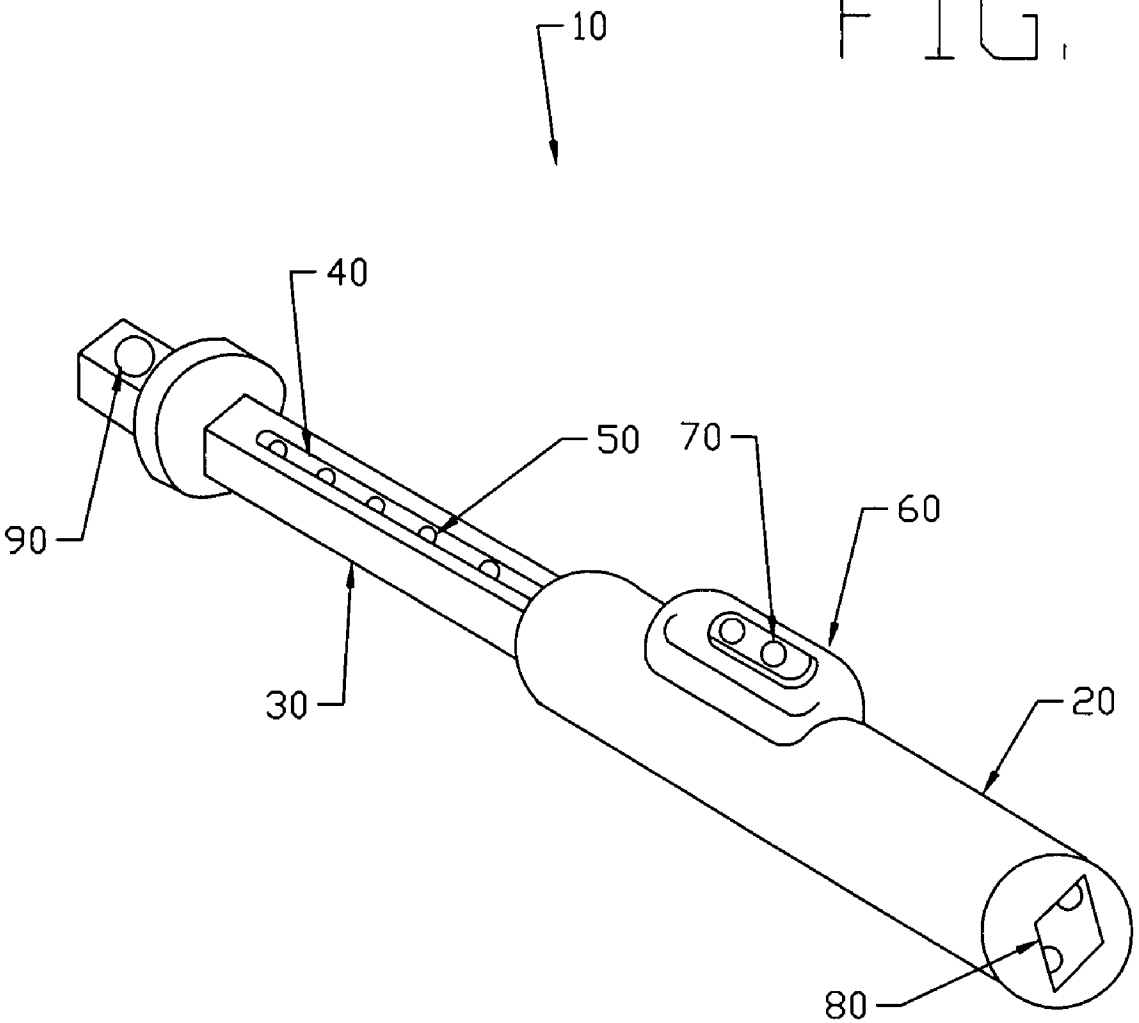
FIG. 1 is a perspective view of the extendable socket extension.

FIG. 1 illustrates a perspective view of an extendable socket extension 10 comprising a first piece 20, a second piece 30, a groove 40, holes 50, a raised collar 60, a thumb button 70, a square bore 80 and a ball bearing connection 90. The extendable socket extension 10 comprises a first piece 20 and a second piece 30 that are slideably connected. By pressing the thumb button 70 on the raised collar 60 which is located on the first piece 20, the second piece 30 will slide in or out of the first piece 20. The first piece 20 comprises an internal square bore 80 which allows the first piece 20 to be attached to a hand ratchet or an air ratchet. The second piece 30 comprises a ball bearing connection 90 which allows for the attachment of a socket wrench. Once the socket wrench is attached to the ball bearing connection 90 and a ratchet is attached to the first piece 20 at the internal square bore 80, the length must be determined. By pressing the thumb button 70, the second piece 30 can be extended to the proper position for attaching to a bolt or screw. Once the proper length is determined, releasing the thumb button 80 allows the second piece 30 to be locked into position. The extendable socket extension 10 is now ready to use to remove or tighten a bolt or screw.

Figure 2:
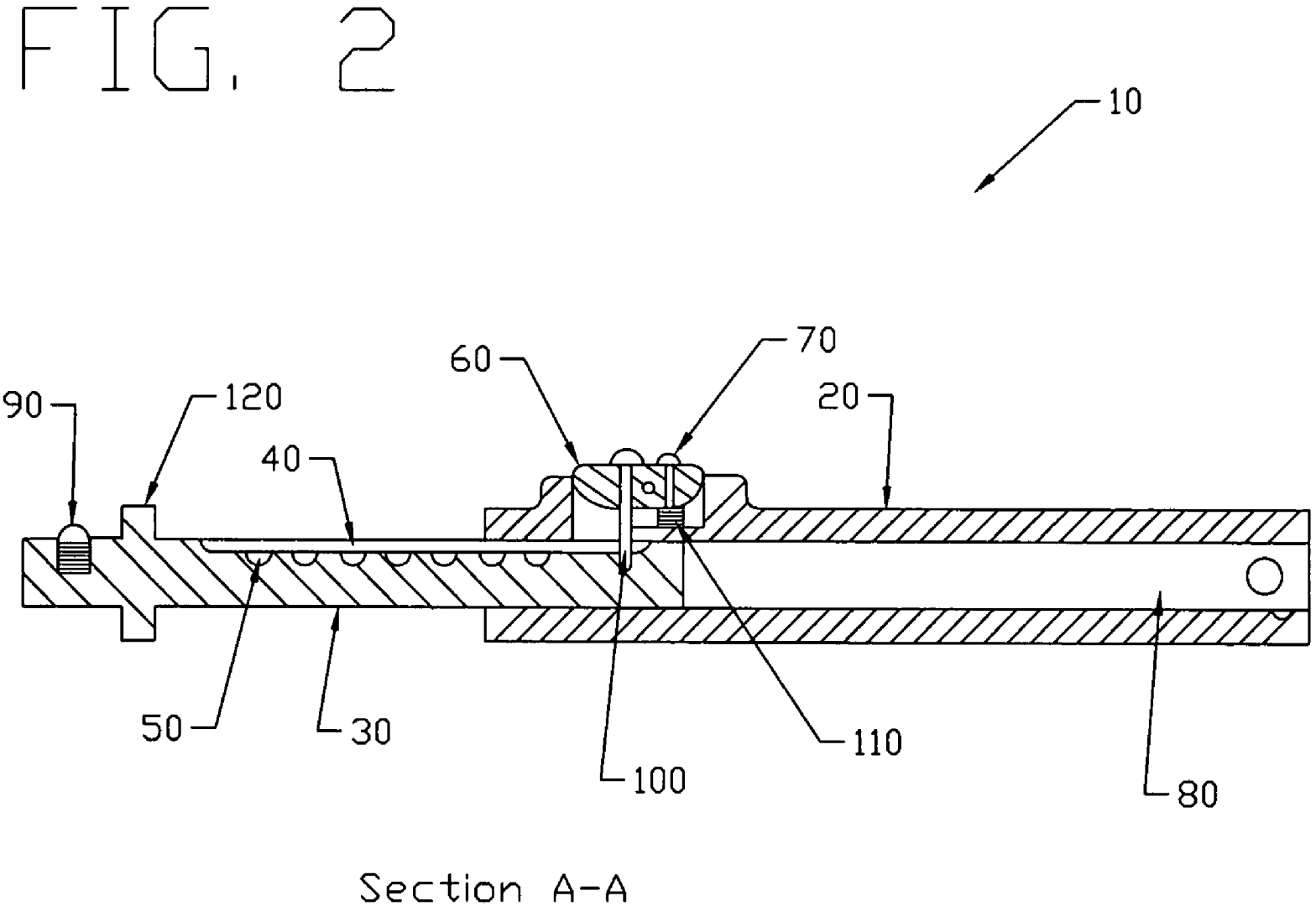
FIG. 2 is a cross-sectional view of FIG. 1 further depicting the inside workings of the extendable socket extension.

FIG. 2 depicts the internal cavity of the extendable socket extension 10. If further illustrates a locking pin 100 and a spring 110. By pressing the thumb button 70, the spring 110 operates to release the locking pin 100. Once the second piece 30 is extended or retracted to the appropriate length, releasing the thumb button 70 causes the spring 110 to engage the locking pin 100 thereby locking the second piece 30 into the predetermined length. Additionally, FIG. 2 illustrates a collar 120 located near the ball bearing connection 90 on the second piece 30. Also illustrated in FIG. 2 is view of the internal cavity showing the square bore 80 and further illustrating the square shaft of the second piece 30.

By using the extendable socket extension 10, the ability to reach bolts and screws in tight areas becomes a simpler task. For example, a mechanic can now reach bolts and screws that might otherwise require the removal of unnecessary parts to reach. The extendable socket extension 10 can be utilized for lots of other tasks too, including jobs involving working various types of machines, plumbing and carpentry. By using the extendable socket extension 10, it allows a user to reach places that might otherwise be very difficult and time consuming. Also, the use of the extendable socket extension 10 can help reduce cost by providing a way to reach various bolts and screws that might otherwise be unreachable without the removal of other objects. If a user were required to remove additional objects, the time involved increases costs.

Although an embodiment of the present invention has been shown and described in detail herein, along with certain variants thereof, many other varied embodiments that incorporate the teachings of the invention may be easily constructed by those skilled in the art. Accordingly, the present invention is not intended to be limited to the specific form set forth herein, but on the contrary, it is intended to cover such alternatives, modifications, and equivalents, as can be reasonably included within the spirit and scope of the invention.

What is claimed:

1. An extendable socket extension comprising:

a first piece wherein said first piece comprises an attachment for attaching a ratchet;

a second piece operable to extend from said first piece; wherein said second piece comprises a ball bearing connection operable to attach a socket;

a locking pin located in said first piece operable to hold said second piece at a designated length; and a rocker switch release mechanism operable to allow said second piece to extend from said first piece.

2. An extendable socket extension of claim 1, further comprising a raised collar attached to said first piece wherein said rocker switch release mechanism is located.

3. An extendable socket extension of claim 1, wherein said rocker switch release mechanism is operable release said second piece allowing said second piece to retract.

4. An extendable socket extension of claim 1, wherein said rocker switch release mechanism operates to engage and release said locking pin.

5. An extendable socket extension of claim 1, wherein said first piece further comprises an internal square bore.

6. An extendable socket extension of claim 1, wherein said second piece is a square shaft.

7. An extendable socket extension of claim 1, wherein said second piece comprises a groove containing a set of holes operable to insert a locking pin.

8. An extendable socket extension of claim 7, wherein said holes are at a specified interval.

9. An extendable socket extension of claim 1, further comprising a thumb button.

10. A method of using an extendable socket extension comprising a first piece, a second piece, a locking pin; and a rocker switch release mechanism;

wherein said first piece is attached to a ratchet on a first end;

a socket is attached to said second piece on a first end;

extending said second piece from said first piece on said second end by disengaging the locking pin using said rocker switch release mechanism;

re-engaging said locking pin to hold said first piece and said second piece at a specified length;

using the ratchet attached to said first end on said first piece to rotate the ratchet so as to cause the socket to rotate in a tightening or loosening manner.

11. A tool comprising:

a ratchet having a first end and an extendable socket extension having:

a first piece comprising an attachment for removably attaching to said ratchet on said first end;

said first piece comprising a raised collar housing a rocker switch release mechanism;

said raised collar comprising a locking pin;

a second piece comprising a spring-loaded ball bearing operable to attach to a socket on a first end;

said second piece is operable to extend and retract from said first piece on a second end;

said second piece comprises a groove containing a set of holes; and said rocker switch release mechanism operates to disengage and engage a locking pin located inside of said first piece.

12. An extendable socket extension system of claim 11, wherein said holes are located at a specified interval.

13. An extendable socket extension of claim 11, wherein said first piece further comprises an internal square bore.

14. An extendable socket extension of claim 11, wherein said second piece is comprised of a square shaft.

15. An extendable socket extension of claim 11, wherein said locking switch mechanism further comprises a thumb button.

16. An extendable socket extension of claim 11, wherein said second piece is slideably connected to said first piece.

* * * * *